US011613895B2

(12) United States Patent
Sprague

(10) Patent No.: US 11,613,895 B2
(45) Date of Patent: Mar. 28, 2023

(54) PANEL SECURING SYSTEM AND METHOD

(71) Applicant: Gary Sprague, Visalia, CA (US)

(72) Inventor: Gary Sprague, Visalia, CA (US)

(73) Assignee: FRAMELESS HARDWARE COMPANY LLC, South Gate, CA (US)

( * ) Notice: Subject to any disclaimer, the term of this patent is extended or adjusted under 35 U.S.C. 154(b) by 134 days.

(21) Appl. No.: 17/239,338

(22) Filed: Apr. 23, 2021

(65) Prior Publication Data

US 2022/0049501 A1 Feb. 17, 2022

Related U.S. Application Data

(60) Provisional application No. 63/066,018, filed on Aug. 14, 2020.

(51) Int. Cl.
*E04F 11/18* (2006.01)

(52) U.S. Cl.
CPC ..... *E04F 11/1817* (2013.01); *E04F 11/1853* (2013.01); *E04F 2011/1823* (2013.01)

(58) Field of Classification Search
CPC . E04F 11/181; E04F 11/1812; E04F 11/1814; E04F 11/1817; E04F 11/1851; E04F 11/1853; E04F 2011/1823; E04F 2011/1825; E04F 2011/182; F16B 5/06; F16B 5/0607; F16B 5/0621; F16B 5/0628; F16B 5/0635; F16B 5/0685; Y10T 403/7047; Y10T 403/7051; Y10T 403/7052
USPC ..... 52/126.3, 126.5, 204.6, 832
See application file for complete search history.

(56) References Cited

U.S. PATENT DOCUMENTS

2004/0071507 A1* 4/2004 Kim ..... E04C 5/165 403/368
2010/0058678 A1* 3/2010 Lutz ..... E06B 1/6069 52/126.1
2015/0265232 A1* 9/2015 Kodaira ..... A61B 6/035 378/15
2015/0267415 A1* 9/2015 Zhou ..... E04F 11/1853 52/208
2021/0172178 A1* 6/2021 Seeboth ..... E04B 2/7401

* cited by examiner

*Primary Examiner* — William V Gilbert
(74) *Attorney, Agent, or Firm* — Cohen IP Law Group, PC; Michael N. Cohen

(57) ABSTRACT

A securing system for use with glass panels is provided. The securing system provides clamping and securing forces to a panel held within a base shoe system, e.g., of a frameless glass guard railing. The securing system includes a back plate with separately tapered portions, and a shim assembly including tapered shim members. Each tapered shim member overlays a separately tapered portion of the back plate and is laterally positionable thereupon. Downward forces applied to the shim members are translated into lateral forces causing the shim members to move laterally in relation to the back plate. These lateral translations cause the system's width to increase to secure the panel within the base shoe and/or decrease to release the panel from the base shoe. The system also includes tools to apply said downward forces.

14 Claims, 14 Drawing Sheets

PANEL SECURING SYSTEM AND METHOD

CROSS-REFERENCE TO RELATED APPLICATIONS

This application claims priority to U.S. Provisional Application No. 63/066,018, filed Aug. 14, 2020, the entire contents of which are hereby fully incorporated herein by reference for all purposes.

FIELD OF THE INVENTION

This invention relates to guard railing systems, including frameless glass guard railing base shoe securing systems and methods.

BACKGROUND

Frameless glass panel guard rail systems for use with commercial and/or residential buildings typically utilize rail systems to provide support to the glass panels while in use. The rail systems typically include a base shoe that extends along the bottom edge and/or the top edge of the glass panels that are designed to maximize the structures' "frameless" appearance.

In some instances, the glass panels are permanently secured within the rail systems such that if the glass panels become broken or otherwise need replacement, the rail systems also must be replaced. This adds cost and additional labor.

In some instances, the glass panels are removably configured with the rail systems, thereby avoiding this problem. However, current removable rail systems are difficult to assemble, require complicated tools to install, do not provide a uniform attachment pressure to the glass panels, and are generally bulky.

Accordingly, there is a need for a removable rail system for use with frameless glass panel guard rail systems that is easy to install using simple tools, that provides uniform attachment pressure to the glass panels for fragile laminated glass, and that is streamlined in appearance.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF EXEMPLARY EMBODIMENTS

As used herein, unless used otherwise, the following terms and abbreviations have the following meanings:

Outboard means towards the outside, and in the case of a guard railing system and associated panel, towards the area outside the guard railing system and panel. Unless otherwise stated, this will typically be depicted in the FIGS as the portion of the system to the left of the system's median plane.

Inboard means towards the inside, and in the case of a guard railing system and associated panel, towards the area outside the guard railing system and panel. Unless otherwise stated, this will typically be depicted in the FIGS as the portion of the system to the right of the system's median plane.

Lateral means towards the side, and in the case of a guard railing system and associated panel, facing away from the middle (the median plane) of the guard railing or panel.

Medial means towards the middle, and in the case of a guard railing system and associated panel, facing towards the middle (the median plane) of the guard railing or panel.

In general, the system according to exemplary embodiments hereof provides a system and method for securing an apparatus. The securing system effectively translates forces applied along the plane of a first axis into the plane of a second axis. For example, in some embodiments, the system translates forces applied along a generally vertical axis (e.g., a Y-axis) into a generally horizontal axis (e.g., an X-axis). The securing system utilizes the translated forces (e.g., the forces translated from the Y-axis to the X-axis) to cause the lateral motion of one or more devices that in turn cause the tightening and/or loosening of the apparatus being secured. In this way, the system utilizes vertically oriented forces to cause the lateral tightening and/or loosening of the securing devices.

In some embodiments, the securing system may be used to secure a glass panel within a base shoe for implementation as a frameless guard railing. The securing system may be implemented within a channel of a base shoe and be adjusted to secure (e.g., clamp) the panel therein. It is understood that the securing system also may be used with other panel securing systems such as frameless glass doors, door stile systems, door jamb systems, and other types of systems. It also is understood that the securing system may be used to secure other types of structures and/or other types of panels, including structures comprising materials other than glass.

Referring now to FIGS. 1-22, the securing system 10 according to exemplary embodiments hereof will be described in further detail.

Figure 1:
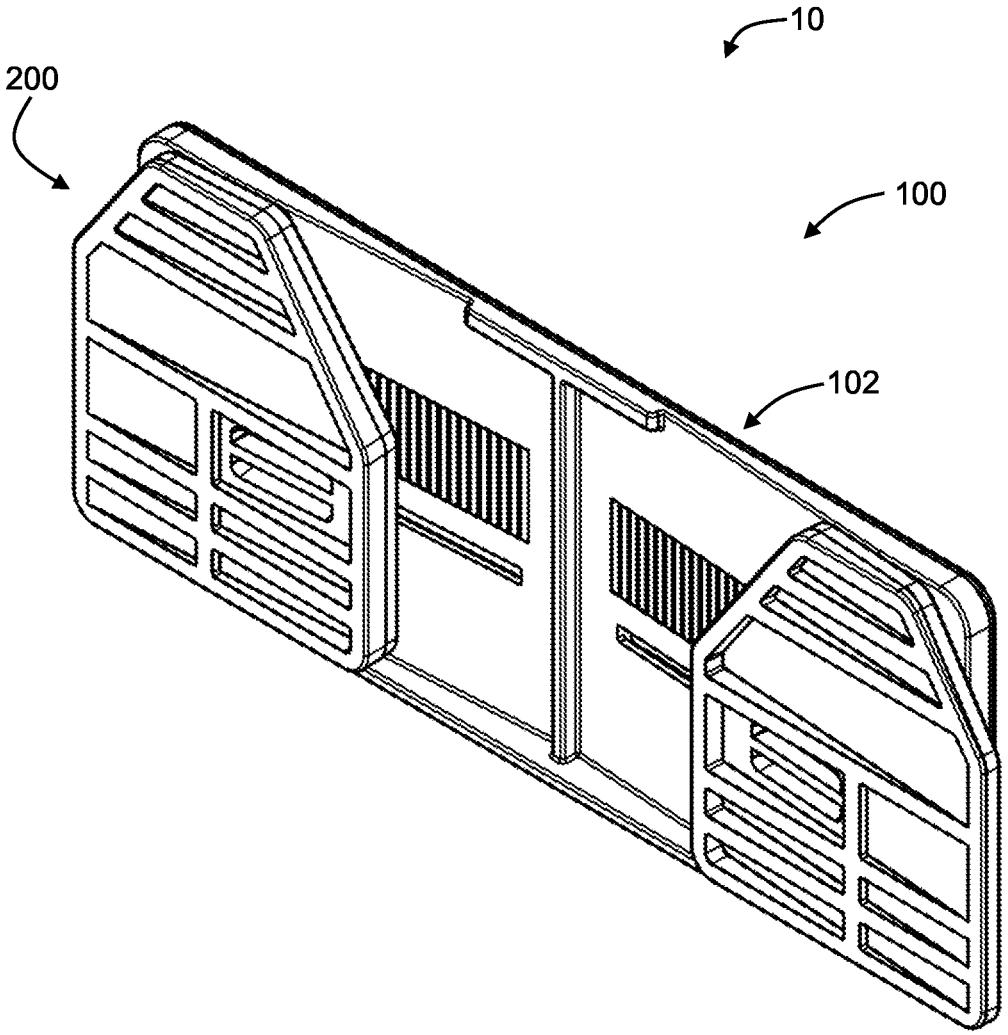
FIG. 1 shows aspects of a panel securing system according to exemplary embodiments hereof.

In one exemplary embodiment hereof as shown in FIG. 1, the system 10 includes a back plate 100 and a shim assembly 200. As described in later sections, the system 10 may be used to secure a glass panel 300 within a base shoe housing 400 (e.g., of a frameless guard railing). In this application, the system 10 also may include a support assembly 500 and one or more tools 600 for easy implementation. The system 10 also may include other elements and components as necessary to fulfill its functionalities.

Back Plate 100

Figure 2:
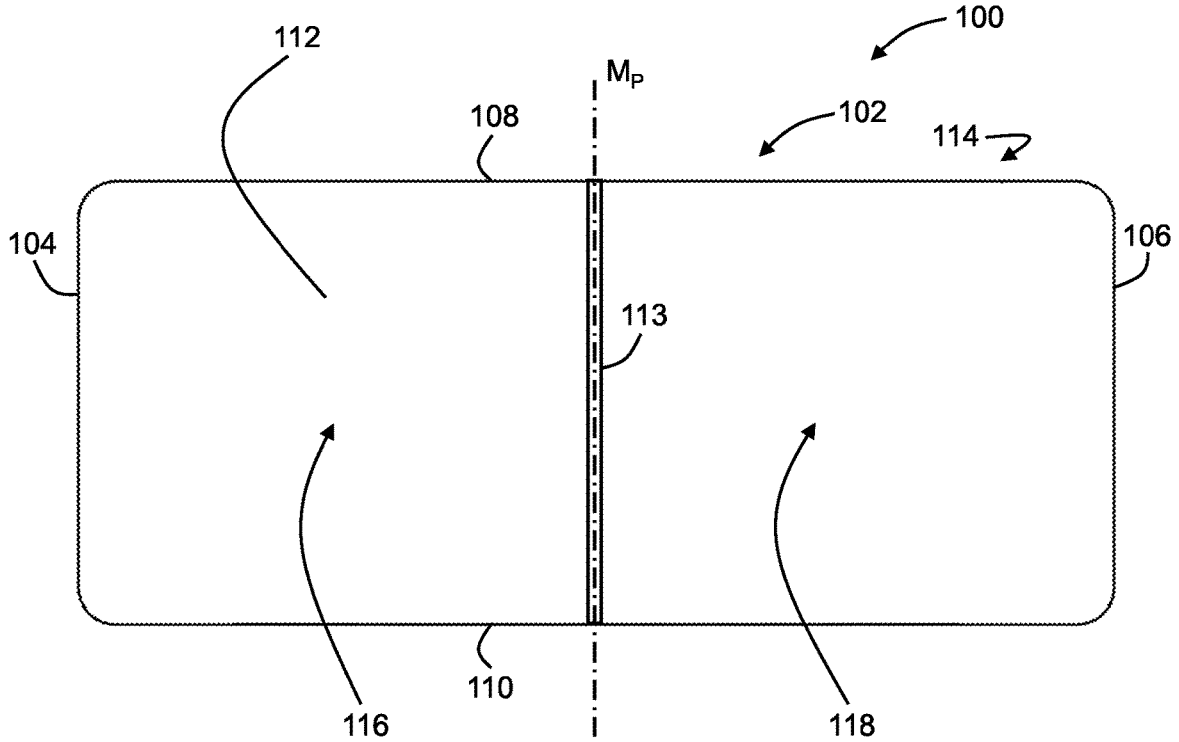
FIGS. 2-3 show aspects of a back plate according to exemplary embodiments hereof.

In some embodiments as shown in FIG. 2, the back plate 100 includes a base plate 102 with a left side 104, a right side 106, a top 108, a bottom 110, a front 112 and a back 114. The front 112 of the base plate 102 may include a midpoint $M_p$ between the left and right sides 104, 106. For the purposes of this specification, the front 112 of the base plate 102 will be primarily described as rectangular in shape, however, it is understood that the front 112 of the base plate 102 may be formed as any suitable shape (e.g., trapezoidal, oval, triangular, etc.) and that the scope of the system 10 is not limited in any way by the shape of the base plate's front 112.

Figure 3:
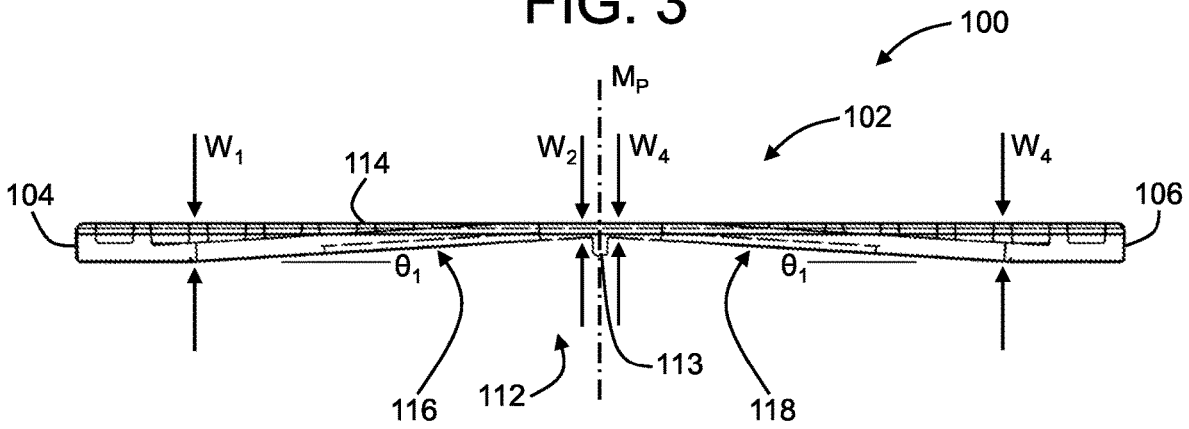

In some embodiments as shown in FIGS. 2-3, the front 112 of the base plate 102 includes one or more distinct surfaces. For example, in some embodiments, the front 112 includes a first distinct surface 116 and a second distinct surface 118. In some embodiments, the first surface 116 extends from left-to-right from a point at or generally adjacent the left side 104 to a first intermediary point on the front 112, and the second surface 118 extends from right-to-left from a point at or generally adjacent the right side 106 to a second intermediary point on the front 112. In some embodiments, the first and second intermediary points are at or adjacent the midpoint $M_p$ of the base plate's front 112. In this case, the first surface 116 may generally extend from the left side 104 to the midpoint $M_p$ from the left, and the second surface 118 may generally extend from the right side 106 to the midpoint $M_p$ from the right. For the purposes of this specification, the base plate 102 will be described predominantly in relation to a configuration in which the first and second surfaces 112, 116 each generally extend to the midpoint $M_p$, however, it is understood that the surfaces 112, 116 may extend to any intermediate points on the base plate 102 and that the scope of the system 10 is not limited in any way with regards to where the surfaces 112, 116 may extend.

In some embodiments, the front 112 includes a stop 113 located at the first and/or second intermediary points, and preferably at the midpoint $M_p$ as shown in FIGS. 2 and 3. In some embodiments, the stop 113 may include a ridge that extends from the top 108 to the bottom 110 adapted to separate the first and second surfaces 116, 118. In some embodiments, the ridge 113 may be about 1-2 millimeters in width and about 1-2 millimeters in height. However, other dimensions also may be used. The purpose of the stop 113 will be described in other sections.

In some embodiments as shown in FIG. 3, the first surface 116 tapers from a point at or generally adjacent the left side 104 to a point at or generally adjacent the first intermediary point (e.g., the midpoint $M_p$). In some embodiments, the first surface 116 tapers at an angle $\phi_1$. In some embodiments, the surface 116 extends generally linearly from left to right such that the tapering is linear and the angle $\phi_1$ is generally fixed and constant along the surface 116. Accordingly, the surface 116 may form a wedge. However, in other embodiments, the surface 116 may include one or more non-linear sections, curvatures, or contours from left to right such that the angle $\phi_1$ may vary at different locations along the surface 116. In any event, the width $W_1$ of the base plate 102 at or adjacent the left side 104 may be larger than the width $W_2$ of the base plate 102 at or adjacent the midpoint Mp due to the tapering of the surface 116.

In some embodiments as shown in FIG. 3, the second surface 118 tapers from a point at or generally adjacent the right side 106 to a point at or generally adjacent the second intermediary point (e.g., the midpoint $M_p$). In some embodiments, the second surface 118 tapers at an angle $\phi_2$. In some embodiments, the surface 118 extends generally linearly from right to left such that the tapering is linear and the angle $\phi_2$ is generally fixed and constant along the surface 118. Accordingly, the surface 118 may form a wedge. However, in other embodiments, the surface 118 may include one or more non-linear sections, curvatures, or contours from right to left such that the angle $\phi_2$ may vary at different locations along the surface 118. In any event, the width $W_3$ of the base plate 102 at or adjacent the right side 106 may be larger than the width $W_4$ of the base plate 102 at or adjacent the midpoint $M_p$ due to the tapering of the surface 118.

It may be preferable that the width $W_1$ equal the width $W_3$, and that the width $W_2$ equal the width $W_4$, but this may not be required.

In some embodiments, the width $W_1$ (and the width $W_3$) is about ⅛" to ⅕", and preferably about ¼", and the width $W_2$ (and the width $W_4$) is about 1/32" to ⅛", and preferably about 3/32"

In some embodiments, the angles $\phi_1$ and $\phi_2$ may be about 0.1° to about 10°, and preferably about 1° to about 5°, and more preferably about 3.5°. The angles $\phi_1$ and $\phi_2$ may preferably be equal or about the same, but this may not be required. It is understood that the angles $\phi_1$ and $\phi_2$ may include any suitable angles and that the scope of the back plate 100 and of the system 10 is not limited in any way by the values of $\phi_1$ and/or $\phi_2$.

In some embodiments as shown in FIG. 3, the back 114 of the base plate 102 is generally flat and extends linearly from its left 104 to its right 106. However, it is understood that the back 114 may include non-linear sections, curvatures and/or other elements as described herein.

Given the above, the base plate 102 may be seen to generally include two adjacent and opposing wedges positioned apex-to-apex.

In some embodiments, the base plate 102 may comprise 20% glass fiber-Polycarbonate with carbon black colorant, or any other types of suitable materials.

Shim Assembly 200

Figure 4:
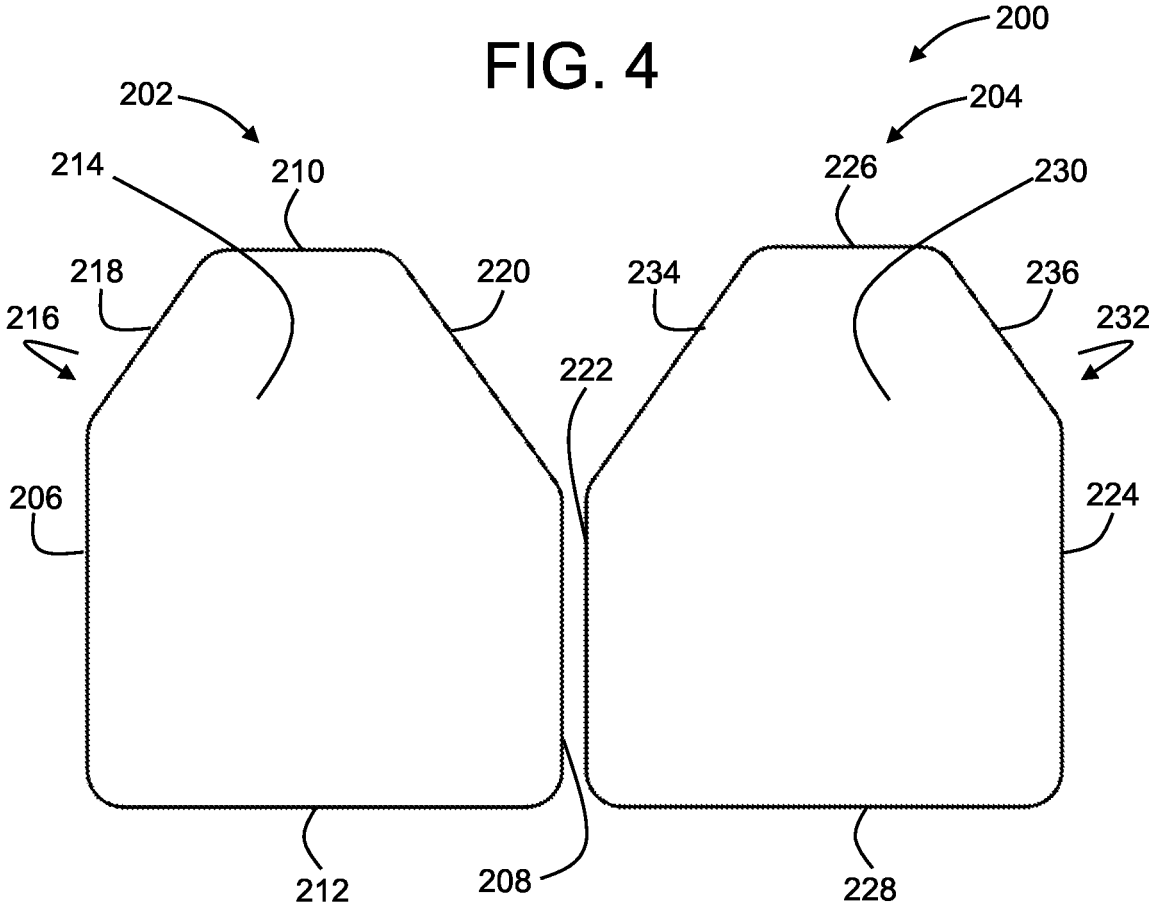
FIGS. 4-5 show aspects of a shim assembly according to exemplary embodiments hereof.

In some embodiments as shown in FIG. 4, the shim assembly 200 includes one or more shim members. For example, in some embodiments, the shim assembly 200 includes a first shim member 202 (e.g., a left shim 202) and a second shim member 204 (e.g., a right shim 204). For the purposes of this specification, the system 10 will be described predominantly with respect to the system 10 including two shim members 202, 204. However, it is understood that the system 10 may include any number of shim members and that the scope of the system 10 is not limited in any way by the number of shim members that it may include.

In some embodiments, the first shim member 202 includes a left side 206, a right side 208, a top 210, a bottom 212, a front 214, and a back 216. The first shim 202 also may include an upper left chamfer 218 between the left side 206 and the top 210, and an upper right chamfer 220 between the right side 208 and the top 210. The chamfers 218, 220 may be formed at 30°-60°, and preferably at 40°-50°, and more preferably at about 45°. However, it is understood that the chamfers 218, 220 may be formed at any suitable angle as required. In some embodiments, the upper right chamfer 220 may be larger than the upper left chamfer 218, but this may not be required.

Figure 5:
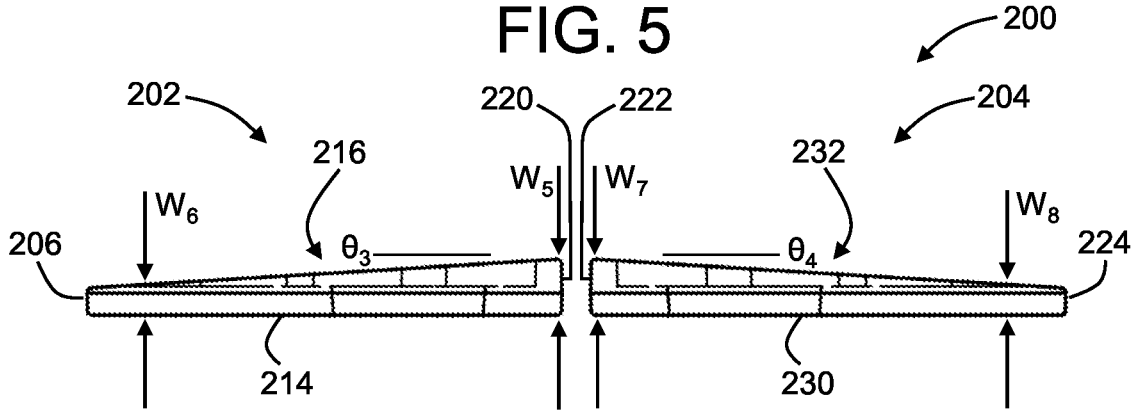

In some embodiments as shown in FIG. 5, the back 216 of the first shim member 202 tapers from a point at or generally adjacent its right side 208 to a point at or generally adjacent its left side 206. In some embodiments, the back 216 tapers at an angle $\phi_3$. In some embodiments, the back 216 extends generally linearly from right to left such that the tapering is linear and the angle $\phi_3$ is generally fixed and constant along the back 216. Accordingly, the back 216 may form a wedge. However, in other embodiments, the back 216 may include one or more non-linear sections, curvatures, or contours from right to left such that the angle $\phi_3$ may vary at different locations along the back 216. In any event, the width $W_5$ of the first shim 202 at or adjacent its right side 208 may be larger than the width $W_6$ of the first shim 202 at or adjacent its left side 206 due to the tapering of its back 216.

In some embodiments as shown in FIG. 5, the front 214 of the first shim member 202 is generally flat and extends linearly from its left 206 to its right 208. However, it is understood that the front 214 may include non-linear sections, curvatures and/or other elements as described herein.

In some embodiments, the second shim member 204 includes a left side 222, a right side 224, a top 226, a bottom 228, a front 230, and a back 232. The second shim 204 also may include an upper left chamfer 234 between the left side 222 and the top 226, and an upper right chamfer 236 between the right side 224 and the top 226. The chamfers 234, 236 may be formed at 30°-60°, and preferably at 40°-50°, and more preferably at about 45°. However, it is understood that the chamfers 234, 236 may be formed at any suitable angle as required. In some embodiments, the upper left chamfer 234 may be larger than the upper right chamfer 236, but this may not be required.

In some embodiments as shown in FIG. 5, the back 232 of the second shim member 204 tapers from a point at or generally adjacent its left side 222 to a point at or generally adjacent its right side 224. In some embodiments, the back 232 tapers at an angle $\phi_4$. In some embodiments, the back 232 extends generally linearly from left to right such that the tapering is linear and the angle $\phi_4$ is generally fixed and constant along the back 232. Accordingly, the back 232 may form a wedge. However, in other embodiments, the back 232 may include one or more non-linear sections, curvatures, or contours from right to left such that the angle $\phi_4$ may vary at different locations along the back 232. In any event, the width $W_7$ of the second shim 204 at or adjacent its left side 222 may be larger than the width $W_8$ of the second shim 204 at or adjacent its right side 224 due to the tapering of its back 232.

In some embodiments as shown in FIG. 5, the front 230 of the second shim member 204 is generally flat and extends linearly from its left 222 to its right 224. However, it is understood that the front 230 may include non-linear sections, curvatures and/or other elements as described herein.

In some embodiments, the first and second shims 202, 204 may comprise 20% glass fiber-Polycarbonate with carbon black colorant, or any other types of suitable materials.

Adjustment Assembly 12

Figure 6:
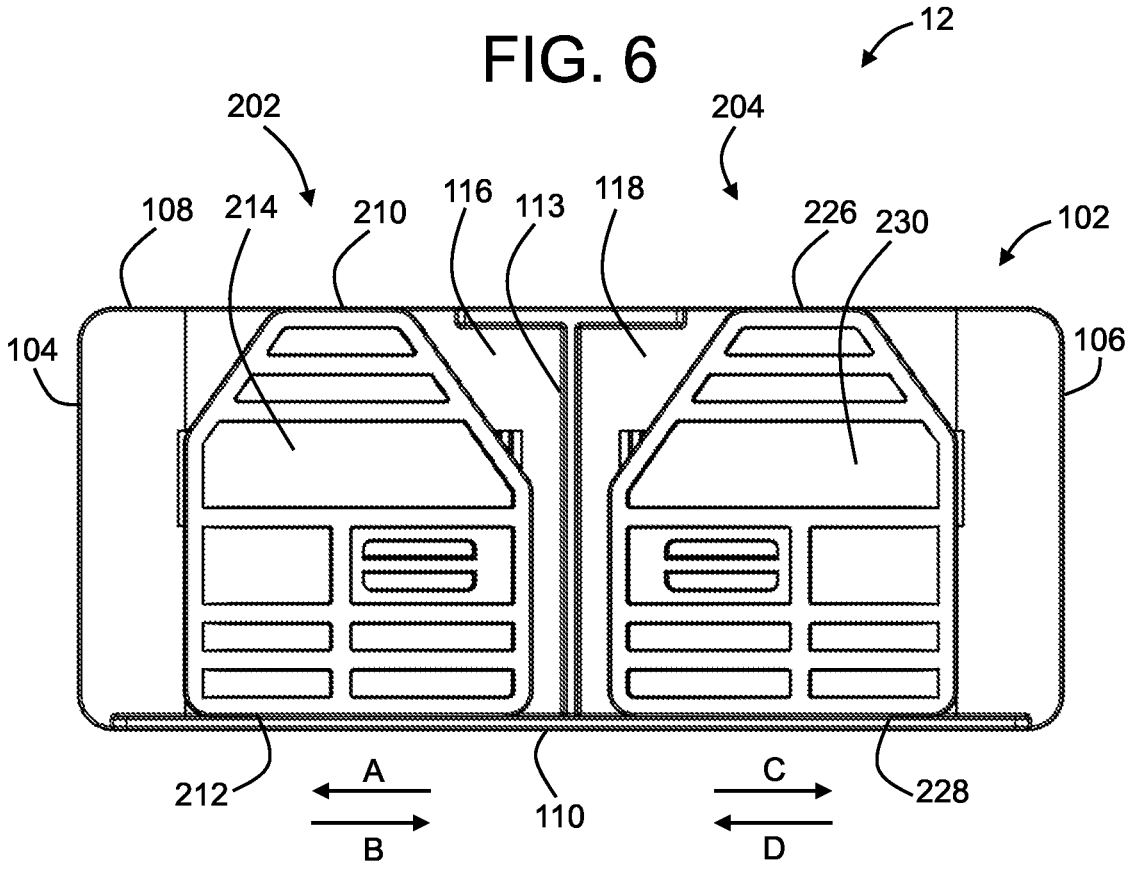
FIGS. 6-12 show aspects of an adjustment assembly according to exemplary embodiments hereof.
Figure 7:
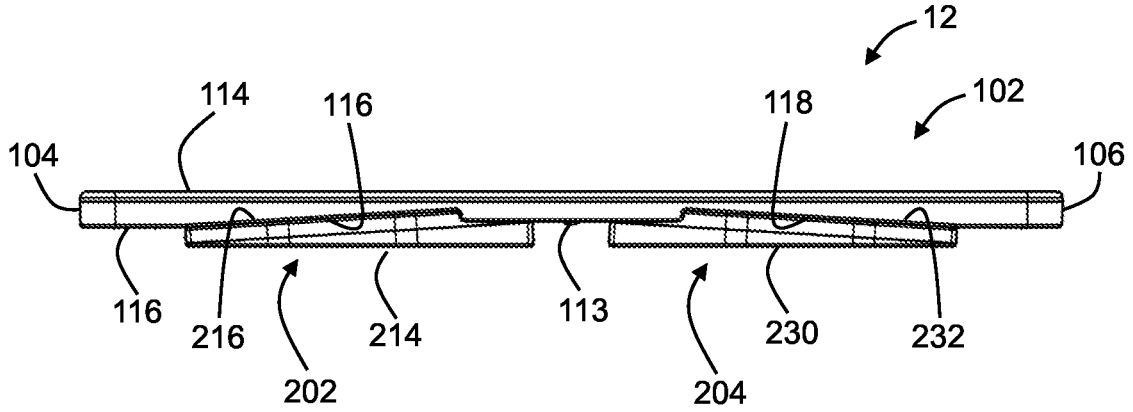

In some embodiments as shown in FIGS. 6 and 7, the system 10 includes an adjustment assembly 12 comprising a shim assembly 200 configured with a back plate 100. Using the example shown, the back 216 of the left shim member 202 may be overlaid with the surface 116 of the base plate 102, and the back 232 of the right shim member 204 may be overlaid with the surface 118 of the base plate 102. In this configuration, the top 210 of the first shim 202 and the top 226 of the second shim 204 may each generally align with the top 108 of the base plate 102. In addition, the bottom 212 of the first shim 202 and the bottom 228 of the second shim 204 may each generally align with the bottom 110 of the base plate 102. However, these alignments may not be necessary.

Figure 8:
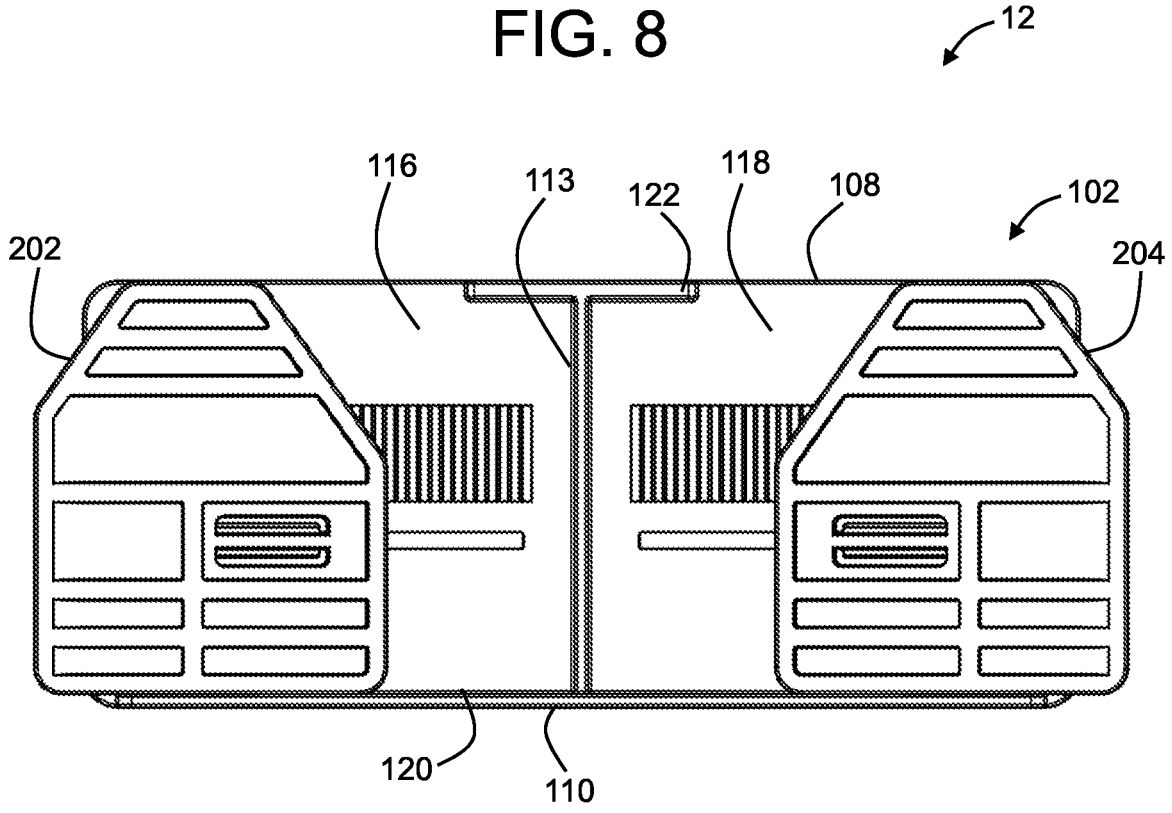
Figure 9:
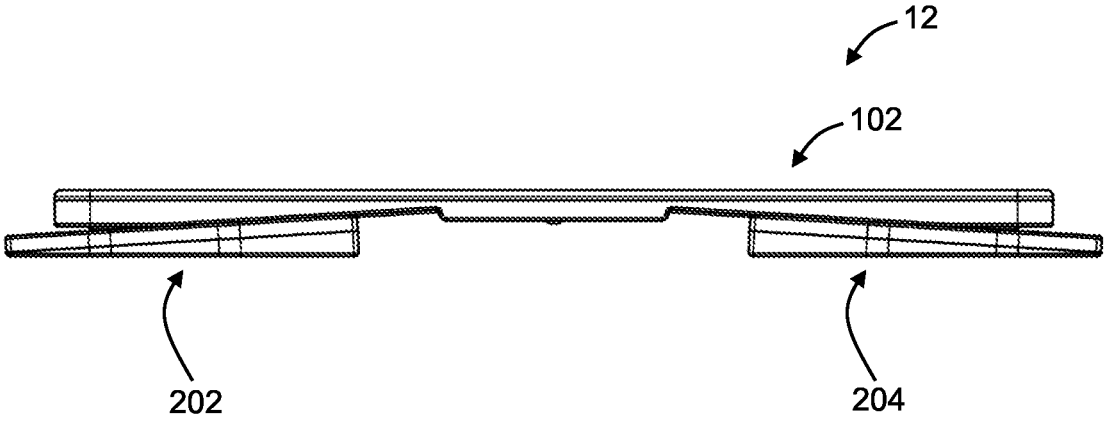

In some embodiments, the base plate 102 includes a bottom ledge 120 generally aligned with and parallel to the bottom 110 of the base plate 102. In some embodiments, the ledge 120 is adapted to provide vertical support to the first and second shim members 202, 204. That is, as shown in FIG. 8, the bottoms 212, 228 of the first and second shims 202, 204, respectively, may rest on the ledge 120 when configured as describe herein.

Figure 10:
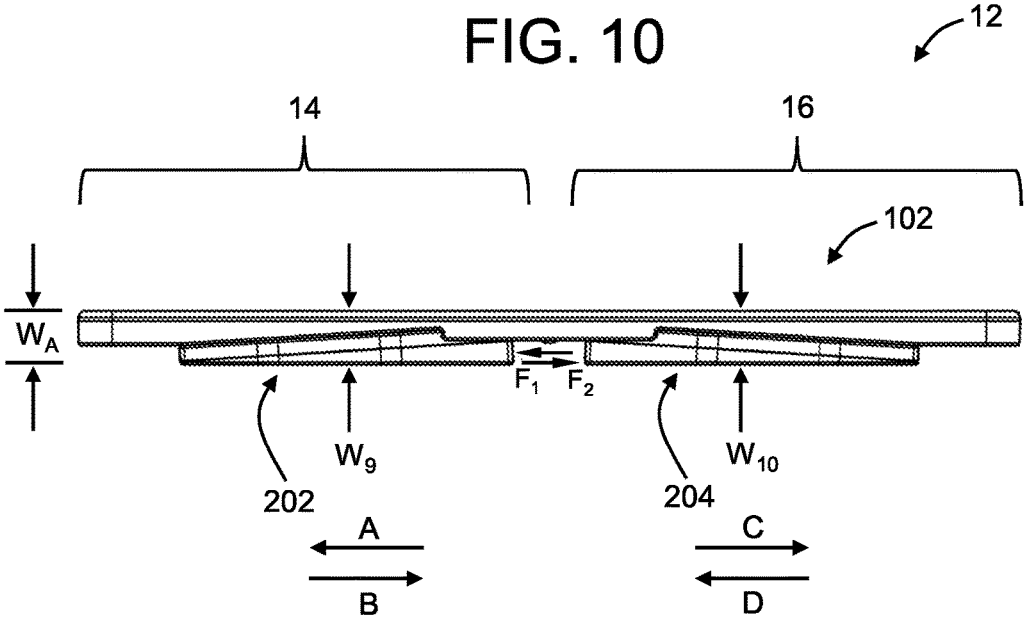
Figure 11:
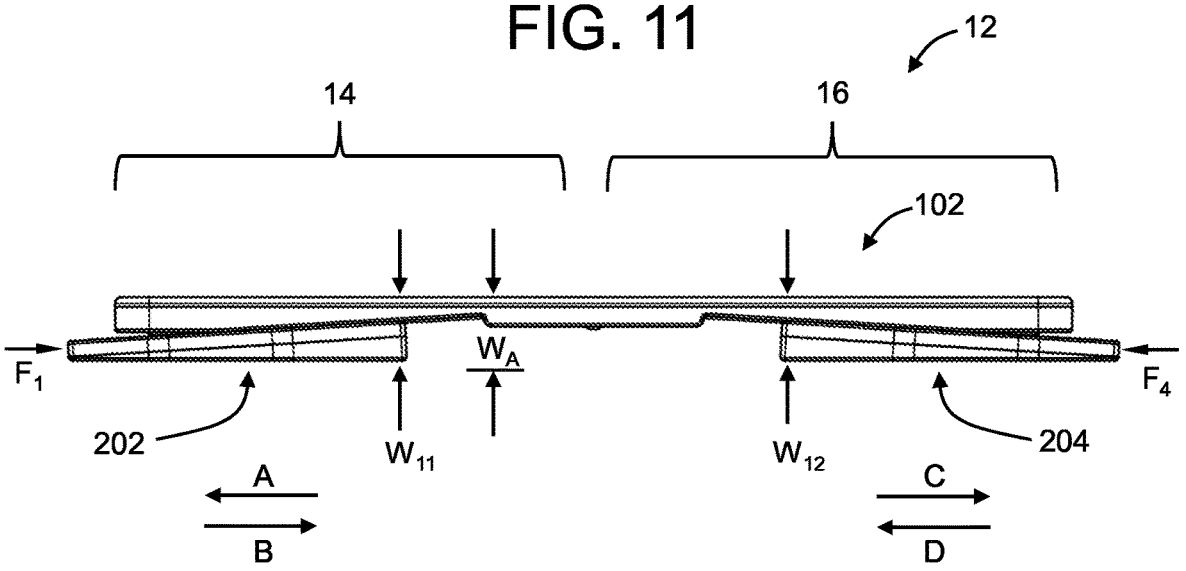

For the purposes of this specification as shown in FIGS. 10 and 11, the portion of the adjustment assembly 12 that includes the first shim 202 overlapping with the base plate's first surface 116 (e.g., the portion from the left 104 to the midpoint $M_p$) will be referred to as the adjustment assembly's left portion 14, and the portion of the adjustment assembly 12 that includes the second shim 204 overlapping with the base plate's second surface 118 (e.g., the portion from the right 106 to the midpoint $M_p$) will be referred to as the adjustment assembly's right portion 16. Accordingly, the assembly's left portion 14 includes two overlapping and opposing tapers comprising the taper of the base plate's surface 116 and the taper of the first shim member's back 216, and the assembly's right portion 16 includes two overlapping and opposing tapers comprising the taper of the base plate's surface 118 and the taper of the second shim member's back 232.

In this configuration as shown in FIGS. 6 and 7, the left shim's back 216 is configured to slide laterally upon the base plate's surface 116 to the left (as represented by the arrow A) and to the right (as represented by the arrow B), and the right shim's back 232 is configured to slide laterally upon the base plate's surface 118 to the right (as represented by the arrow C) and to the left (as represented by the arrow D). In this way, the left and right shims 202, 204 may each move laterally independently of one another. For example, in some embodiments, the left shim 202 may move laterally to the left as the right shim 204 moves laterally to the right (i.e., the shims 202, 204 move away from one another). As such, the shims 202, 204 may transition from the configurations shown in FIGS. 6 and 7 to the configurations shown in FIGS. 8 and 9. In another example, the left shim 202 may move laterally to the right as the right shim 204 moves laterally to the left (i.e., the shims 202, 204 move towards one another). As such, the shims 202, 204 may transition from the configurations shown in FIGS. 8 and 9 to the configurations shown in FIGS. 6 and 7. It is understood that the left and right shims 202, 204 may move in other combinations of directions.

In some embodiments, the base plate 102 includes an upper stop 122 generally aligned with and parallel to the top 108 of the base plate 102 in the area of the midpoint $M_p$. In some embodiments, the stop 122 includes a left end adapted to provide a lateral movement stop to the upper right chamfer 220 of the first shim member 202, and a right end adapted to provide a lateral movement stop to the upper left chamfer 234 of the second shim member 204.

For the purposes of this specification and as shown in FIGS. 10 and 11, the width of the adjustment assembly 12 will be denoted as width $W_A$, the width of the left portion 14 will be denoted as width $W_L$, and the width of the right portion 16 will be denoted as width $W_R$. As will be described below, the widths $W_A$, $W_L$, and $W_R$ are variable.

As shown in FIG. 10, as the first shim member 202 moves from the right to the left (e.g., in the direction of arrow A), the first shim's right side 220 with width W5 travels towards the base plate's left side 104 with width W1, and because of the structure's overlapping tapers as described above, the width of the first shim 202 and the width of the base plate 102 combine increasingly. Accordingly, the width $W_L$ of the left portion 14 increases. For example, the width $W_L$ may increase from W9 (FIG. 10) to W11 (FIG. 11).

Similarly, as the second shim member 204 moves from the left to the right (e.g., in the direction of arrow C), the second shim's left side 222 with width W7 travels towards the base plate's right side 106 with width W3, and because of the structure's overlapping tapers as described above, the width of the second shim 204 and the width of the base plate 102 combine increasingly. Accordingly, the width $W_R$ of the right portion 16 increases. For example, the width $W_R$ may increase from W10 (FIG. 10) to W12 (FIG. 11).

Conversely, as shown in FIG. 11, as the first shim member 202 moves from the left to the right (e.g., in the direction of arrow B), the first shim's left side 206 with width W6 travels towards the base plate's midpoint $M_p$ with width W2, and because of the structure's overlapping tapers as described above, the width of the first shim 202 and the width of the base plate 102 combine decreasingly. Accordingly, the width $W_L$ of the left portion 14 decreases. For example, the width $W_L$ may decrease from W11 (FIG. 11) to W9 (FIG. 10).

Similarly, as the second shim member 204 moves from the right to the left (e.g., in the direction of arrow D), the second shim's right side 224 with width W8 travels towards the base plate's midpoint $M_p$ with width W4, and because of the structure's overlapping tapers as described above, the width of the second shim 204 and the width of the base plate 102 combine decreasingly. Accordingly, the width $W_R$ of the right portion 16 decreases. For example, the width $W_R$ may decrease from W12 (FIG. 11) to W10 (FIG. 10).

Given the above, it is understood that the width $W_A$ of the adjustment assembly 12 may be increased and/or decreased by causing a lateral movement of one or both of the shim members 202, 204.

In some embodiments, a lateral movement of one or both of the shim members 202, 204 is caused by providing one or more lateral forces to the members 202, 204. In one example as shown in FIG. 10, a lateral force F1 applied to the right 208 of the first shim member 202 may cause the member 202 to move to the left in the direction of arrow A, and a lateral force F2 applied to the left 222 of the second shim member 204 may cause the member 204 to move to the right in the direction of arrow C. Accordingly, lateral forces F1 and F2 cause the overall width of the adjustment assembly 12 to increase.

In a second example as shown in FIG. 11, a lateral force F3 applied to the left 206 of the first shim member 202 may cause the member 202 to move to the right in the direction of arrow B, and a lateral force F4 applied to the right 224 of the second shim member 204 may cause the member 204 to move to the left in the direction of arrow D. Accordingly, lateral forces F3 and F4 cause the width $W_A$ of the adjustment assembly 12 to decrease.

Figure 12:
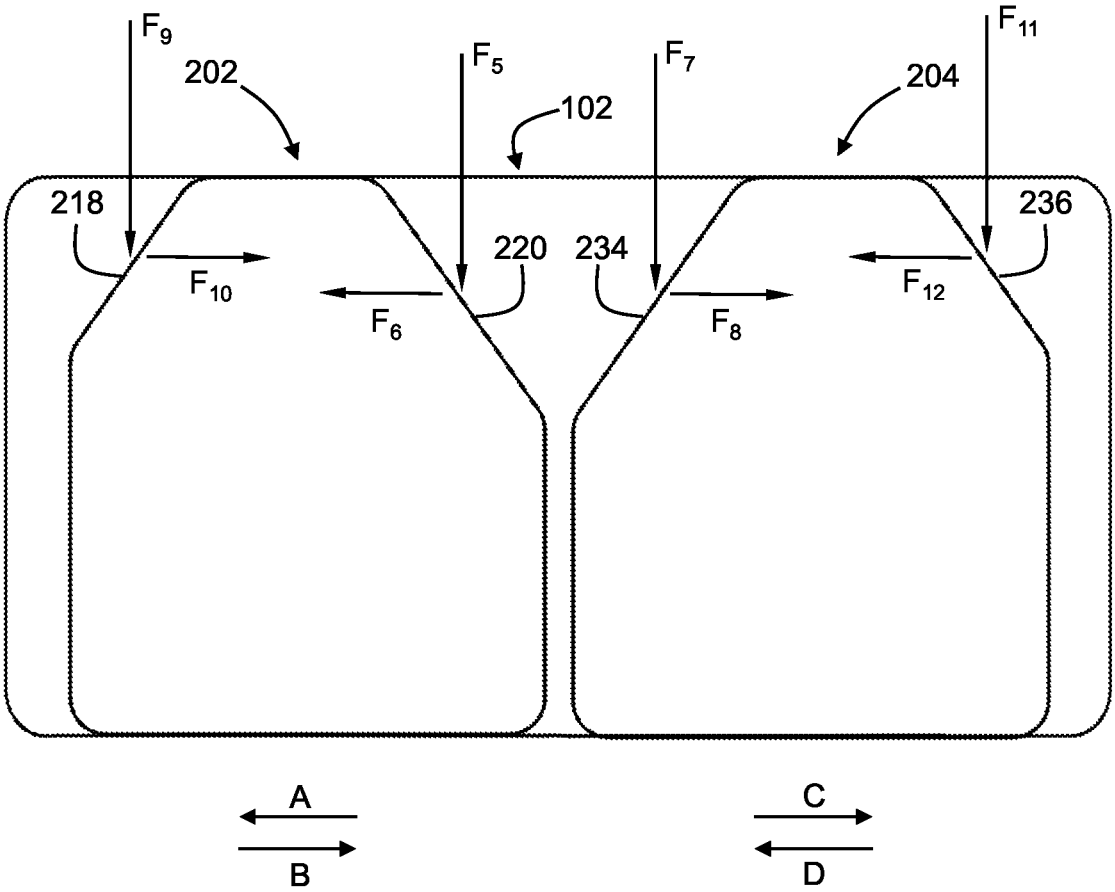

In some embodiments, a lateral movement of one or both of the shim members 202, 204 is caused by providing one or more downward vertical forces to the members 202, 204 that may be translated into corresponding lateral forces. In one example as shown in FIG. 12, a downward vertical force F5 applied to the angled upper right chamfer 220 of the first shim member 202 is translated into a lateral force F6 that in turn may cause the member 202 to move to the left in the direction of arrow A. Similarly, a downward vertical force F7 applied to the angled upper left chamfer 234 of the second shim member 204 is translated into a lateral force F8 that in turn may cause the member 204 to move to the right in the direction of arrow C. Accordingly, downward forces F5, F7 translated into lateral forces F6, F8, respectively, cause the $W_A$ of the adjustment assembly 12 to increase.

In a second example as shown in FIG. 12, a downward vertical force F9 applied to the angled upper left chamfer 218 of the first shim member 202 is translated into a lateral force F10 that in turn may cause the member 202 to move to the right in the direction of arrow B. Similarly, a downward vertical force F11 applied to the angled upper right chamfer 236 of the second shim member 204 is translated into a lateral force F12 that in turn may cause the member 204 to move to the left in the direction of arrow D. Accordingly, downward forces F9, F11 translated into lateral forces F10, F12, respectively, cause the width $W_A$ of the adjustment assembly 12 to decrease.

Accordingly, it is understood that the width $W_A$ of the adjustment assembly 12 may be increased and/or decreased by providing one or more downward vertical forces to one or more of the shim members 202, 204 as described above.

In some embodiments, the base plate surfaces 116, 118 and/or the shim member backs 216, 232 may include frictional elements such as rough surfaces, indents, channels, etchings, slots, detents, teeth, and/or other types of surface textures or elements that may increase the friction between the abutting surfaces 116, 118 and 216, 232, respectively. In other embodiments, the surfaces 116, 118, 216, 232 may be generally smooth. In other embodiments, some of the surfaces 116, 118, 216, 232 may be smooth and other surfaces 116, 118, 216, 232 may include frictional elements. In some embodiments, the base plate 102 and/or the shim members 202, 204 may include cutouts to reduce the weight of the respective items.

In some embodiments, the system 10 may be used to secure a glass panel 300 within a base shoe housing 400 (e.g., of a frameless guard railing). Given this available implementation, a typical base shoe housing 400 and associated panel 300 are described below for reference.

Base Shoe Housing 400 with Panel 300

Figure 13:
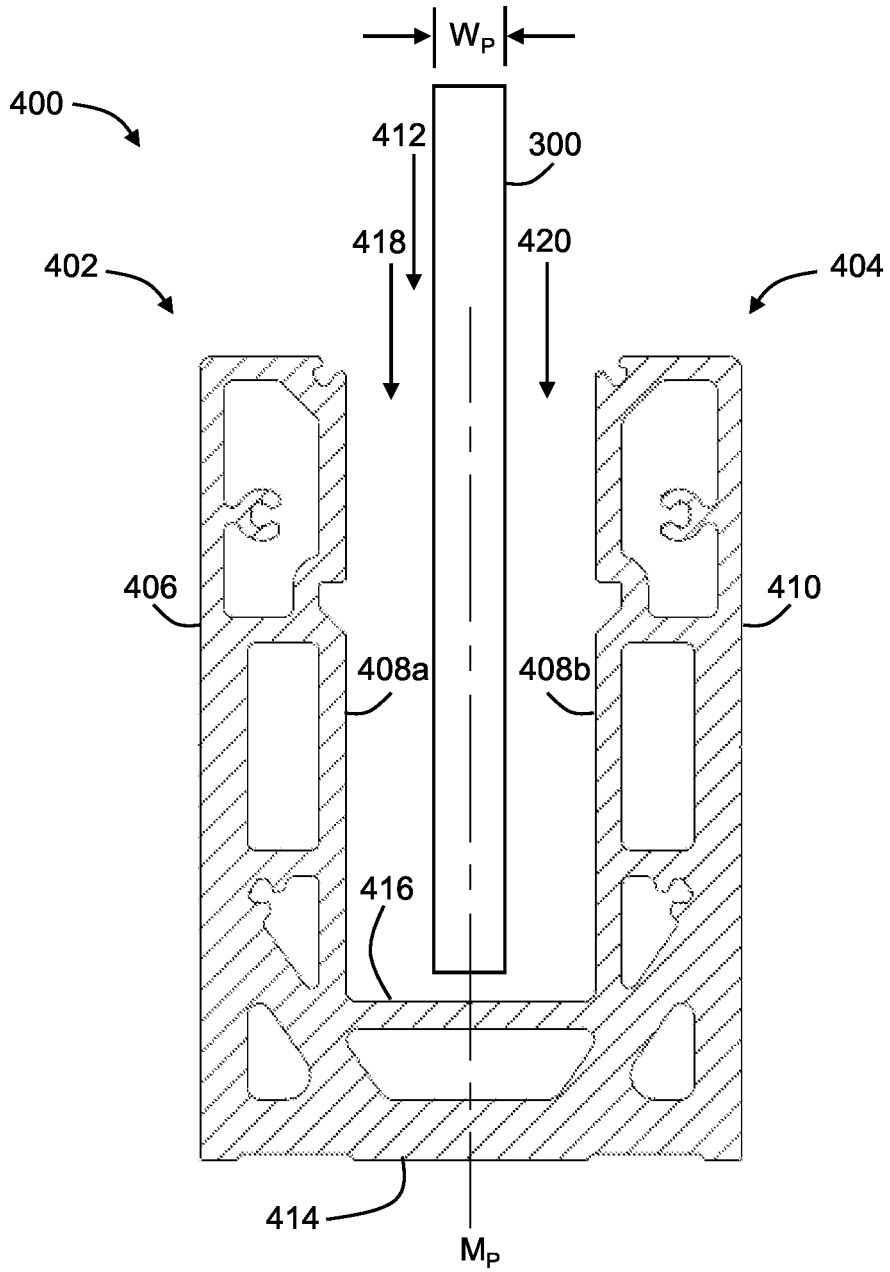
FIG. 13 shows aspects of a base shoe and panel according to exemplary embodiments hereof.

In some embodiments as shown in FIG. 13, a base shoe housing 400 (also referred to as a base shoe) includes an outboard portion 402 and an inboard portion 404, the portions 402, 404 opposing one another about the housing's median plane $M_H$. The housing 400 may comprise aluminum or other materials and may be formed using an extrusion process or other processes. The outboard portion 402 includes an outboard lateral surface 406 and at least one inner channel surface 408*a*. The inboard portion 404 includes an inboard lateral surface 410 and at least one inner channel surface 408*b*. The outboard portion's inner channel surface 408*a* and the inboard portion's inner channel surface 408*b* define the housing's overall inner channel 412 within which the panel 300 is vertically positioned as shown. In some embodiments, the outboard portion's inner channel surface 408*a* and the inboard portion's inner channel surface 408*b* generally mirror one another in regard to positioning, orientation, shape, and size across the inner channel 412. However, this may not be necessary. The outboard portion 402 and inboard portion 404 are joined by a base support 414 that extends laterally between the portions 402, 404 thereby defining the bottom 416 of the inner channel 412.

The panel 300 with width $W_p$ is positioned vertically within the channel 412 (preferably midway between the inner channel surfaces 408*a*, 408*b*) thereby forming a left inner channel 418 between the panel 300 and the inner channel surface 408*a*, and a right inner channel 420 between the panel 300 and the inner channel surface 408*b*.

Support Assembly 500

In some embodiments, a support assembly 500 is included as part of the system 10 (or otherwise) to provide base and lateral support to the panel 300 within the base shoe channel 412.

Figure 14:
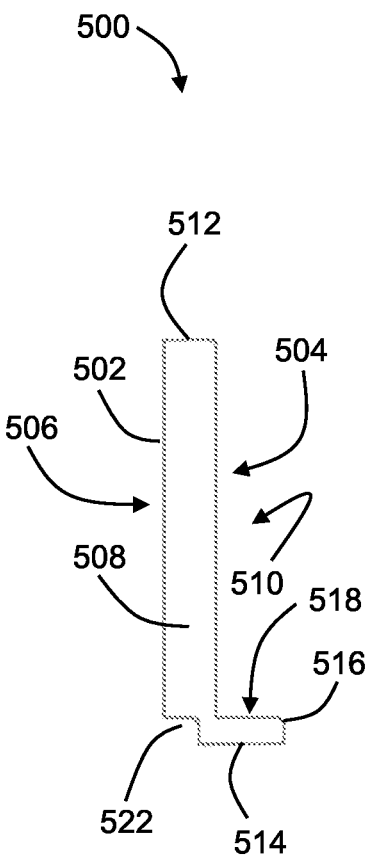
FIGS. 14-15 show aspects of a support assembly according to exemplary embodiments hereof.
Figure 15:
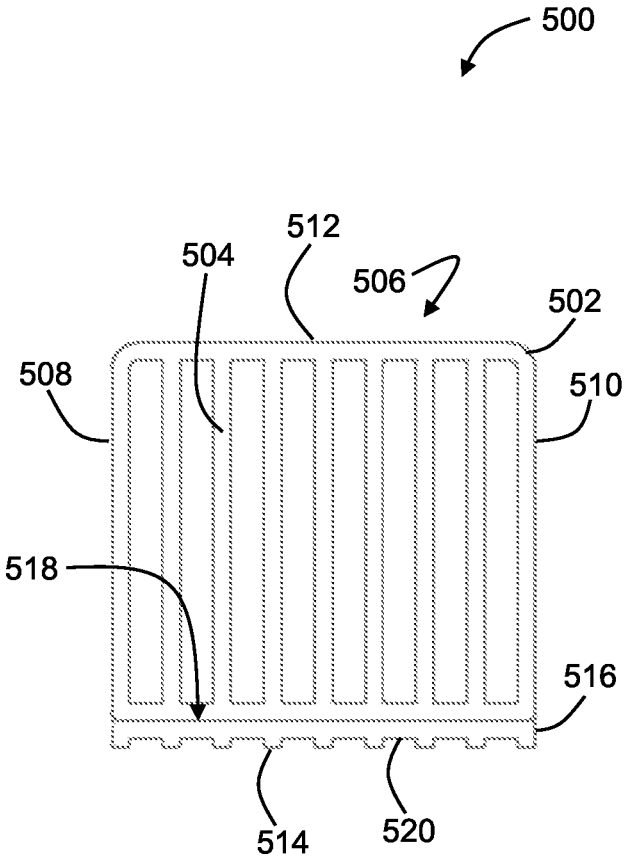

In some embodiments as shown in FIGS. 14 and 15, the support assembly 500 includes a setting block 502 including a front 504, a back 506, a left side 508, a right side 510, a top 512, and a bottom 514. The block 502 may comprise 20% glass fiber-Polycarbonate with carbon black colorant, or any other types of suitable materials.

The width $W_8$ of the block 502 (from the front 504 to the back 306) is preferably constant along the height of the block 502. In some embodiments, the width $W_8$ of the block 502 is chosen to be equal or similar to the width of the adjustment assembly 12. However, other widths may be chosen.

The block 502 may include a foot 516 extending outward from the block's front 504 at its bottom 514. In some embodiments, the foot 516 may extend outward and perpendicular (at 90°) with respect to the front 504. The foot 516 may include a top surface 518 that, as described in other sections, may be adapted to support the bottom side (the bottom edge) of the panel 300. Given this, it may be preferable that the foot's top surface 518 extend outward from the front 504 a distance sufficient to support the bottom of the panel 300. However, it may be preferable that the distance be slightly less than the thickness of the panel 300 so that a portion of the panel's bottom surface may overhang the front of the foot 516. As will be described in other sections, this may allow for the adjustment assembly 12 to engage the panel 400.

In some embodiments, the bottom 514 (including the bottom of the foot 516) may include one or more channels 520 extending from the front 504 (of the foot 516) to the back 506. In some embodiments, the channels 520 may be open towards the bottom 514 with a height that extends upward a portion of the height of the foot 516 (preferably not all the way through the foot 516).

In some embodiments, the block 502 includes a notch 522 in its back 506 at the bottom 514. The notch 522 may extend from the left 508 to the right 510 of the block 502 or portion(s) thereof. In some embodiments, the notch 522 communicates with at least one of the channels 520 so that water that may collect within the channels 520 may pass into the notch 522 to be removed from the housing 400 as will be described in other sections.

Securing the Panel 300 Using the System 10

Figure 16:
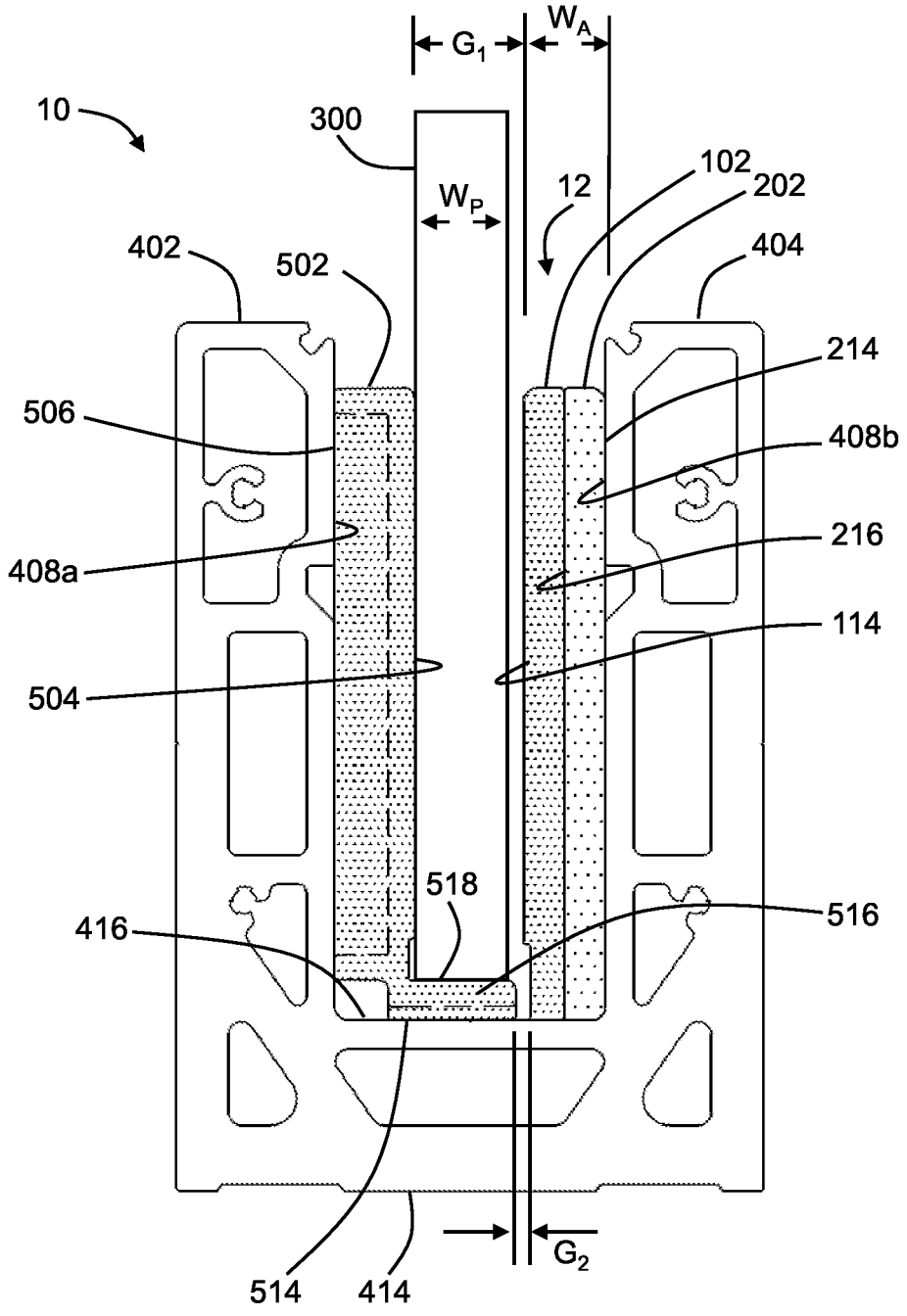
FIGS. 16-18 show aspects of a panel securing system configured with a base shoe housing according to exemplary embodiments hereof.

In some embodiments, to secure the panel 300 within the base shoe 400, the adjustment assembly 12 and the support assembly 500 are positioned within the base shoe channel 412 as shown in FIG. 16. The back 114 of the adjustment assembly 12 is generally abutted against a first housing inner surface 408*a* (or 408*b*) and the back 506 of the setting block 502 is generally abutted against a second housing inner surface 408*b* (or 408*a*). The bottoms 514, 110 of the support assembly 500 and of the adjustment assembly 12, respectively, may each be supported by the bottom 416 of the inner channel 412. In this configuration, a gap $G_1$ is formed between the assemblies 12, 500 into which the panel 300 is vertically positioned as shown. It is preferable that the gap $G_1$ be slightly larger than the width $W_p$ of the panel 300 so that the adjustable width $W_A$ of the adjustment assembly 12 may be increased to reduce the gap $G_1$ and clamp the panel 300 in place. In this configuration, the adjustment assembly 12 controls the clamping force applied to the panel 300 between itself and the support block 502.

In some embodiments, the block's foot 516 extends across the channel's bottom 416 towards the adjustment assembly 12 leaving a gap $G_2$ between the front of the foot 516 and the back 114 of the adjustment assembly's base plate 102. As will be described in other sections, with the panel 300 resting on the top 518 of the foot 516, the adjustable width $W_A$ of the adjustment assembly 12 may be increased as described above to expand at least partially into the gap $G_2$ while applying a clamping force to the panel 300. In this way, the foot 516 may not obstruct the expansion of the adjustment assembly's width $W_A$.

Figure 17:
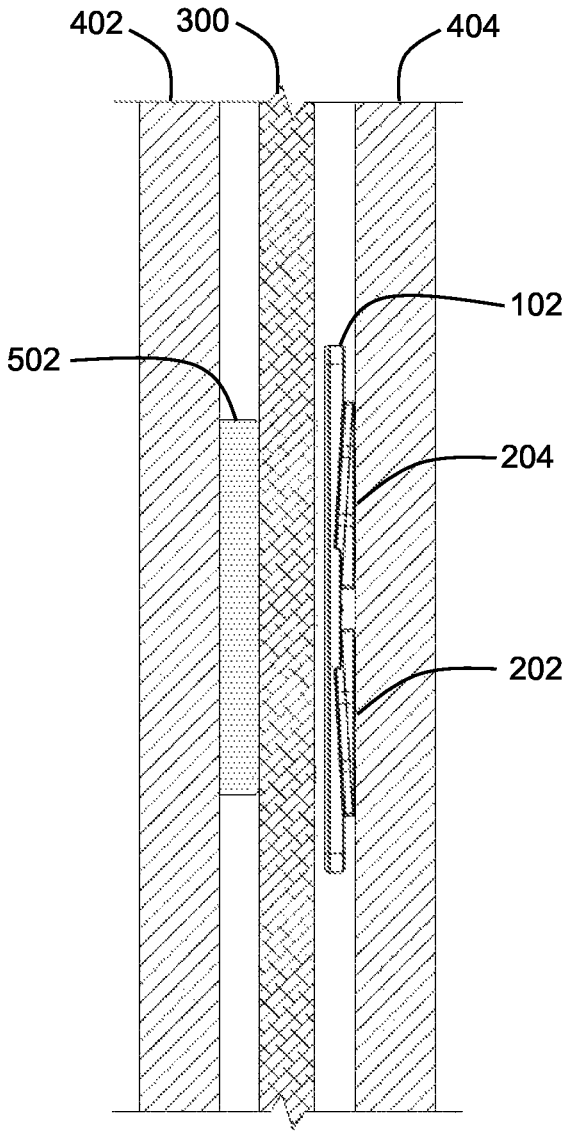

FIG. 17 shows a top view of an adjustment assembly 12 and a support block 502 configured within the base shoe's inner channel 412 opposite one another across the channel 412 and with the panel 300 positioned therebetween in an unclamped configuration. In some embodiments, corresponding pairs of combined adjustment assemblies 12 and support blocks 502 are configured within the base shoe housing 400 at predefined spacings along the longitudinal length of the housing 400. For example, opposing pairs of adjustment assemblies 12 and support blocks 502 may be placed at intervals of about 12"-14" along the longitudinal length of the housing 400. Note that the spacings may be periodic and uniform or may be at varying distances. In this way, as will be described in other sections, the opposing pairs 12, 502 may be adjusted to clamp the panel 300 within the base shoe 400 at these locations.

In some embodiments, the panel 300 is secured by increasing the adjustment assembly's width $W_A$ to expand into the gaps $G_1$ and $G_2$ until the front 114 of the assembly 12 abuts against and applies a clamping force to the panel 300. In this way, the panel 300 is held between the assembly 12 and the block 502 within the housing 400.

Figure 18:
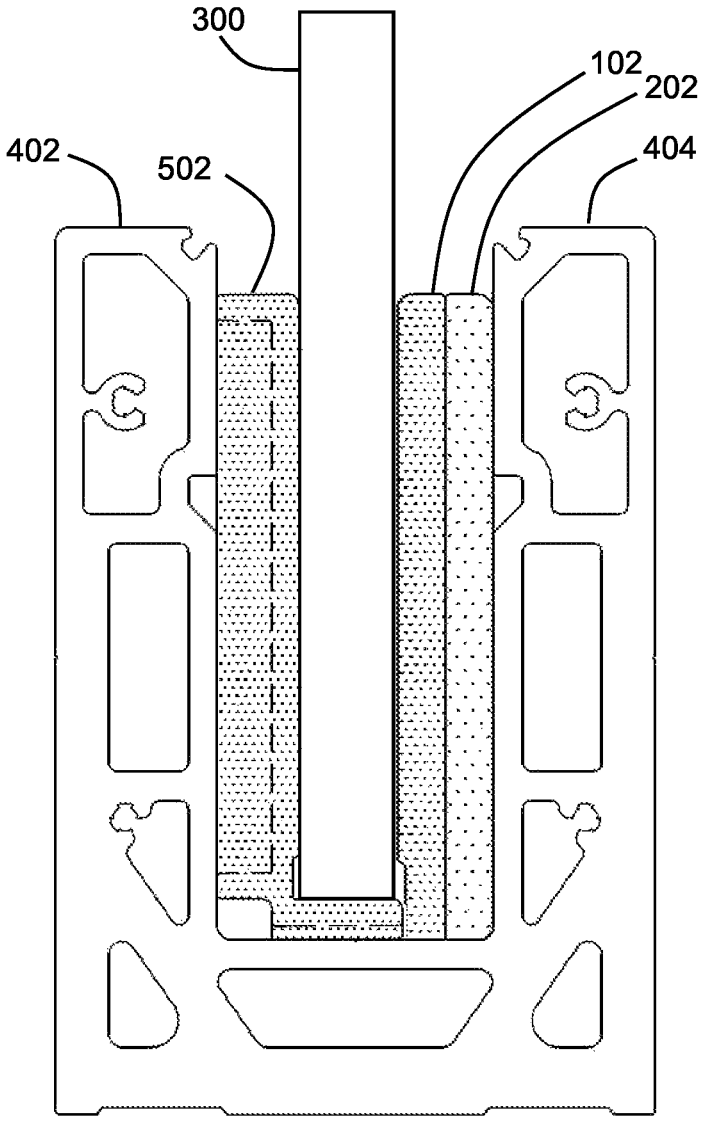

To accomplish this, a downward force (such as the force $F_5$ in FIG. 12) is applied to the upper right chamfer 220 of the first shim member 202 causing the member 202 to move laterally in the direction of arrow A (FIG. 12), and a downward force (such as the force $F_7$ in FIG. 12) is applied to the upper left chamfer 234 of the second shim member 204 causing the member 204 to move laterally in the direction of arrow C (FIG. 12). As described above, this causes the width $W_A$ of the adjustment assembly 12 to increase thereby applying a clamping force to the side of the panel 300 as shown in FIG. 18.

To release the panel 300, the width of the adjustment assembly 12 is decreased thereby expanding the width of the gaps $G_1$ and $G_2$ until the panel 300 is no longer secured.

To accomplish this, a downward force (such as the force $F_9$ in FIG. 12) is applied to the upper left chamfer 218 of the first shim member 202 causing the member 202 to move laterally in the direction of arrow B (FIG. 12), and a downward force (such as the force $F_{11}$ in FIG. 12) is applied to the upper right chamfer 236 of the second shim member 204 causing the member 204 to move laterally in the direction of arrow D (FIG. 12). As described above, this causes the width $W_A$ of the adjustment assembly 12 to decrease thereby releasing the side of the panel 300 as shown in FIG. 18.

Implementation Tools 600

In some embodiments as shown in FIGS. 19-22, one or more implementation tools 600 are used to apply the downward forces to laterally translate the shim members 202, 204. In this way, the tools 600 are used to increase and/or decrease the width $W_A$ of the adjustment assembly 12, thereby securing and/or releasing a panel 300 within a base shoe 400, respectively, as described.

Figure 19:
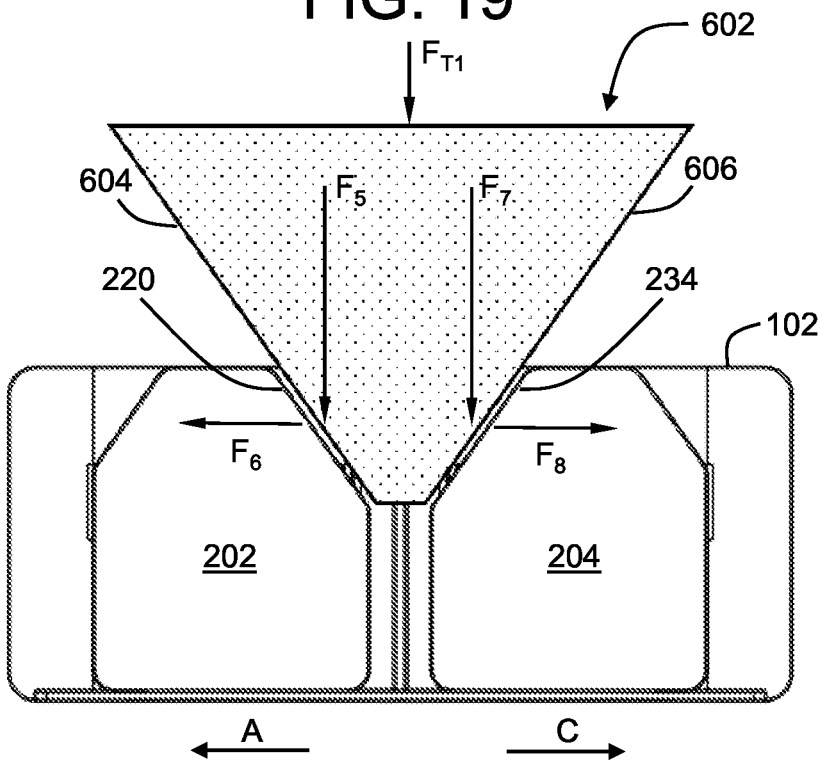
FIGS. 19-22 show aspects of implementation tools configured with a panel securing system according to exemplary embodiments hereof.
Figure 20:
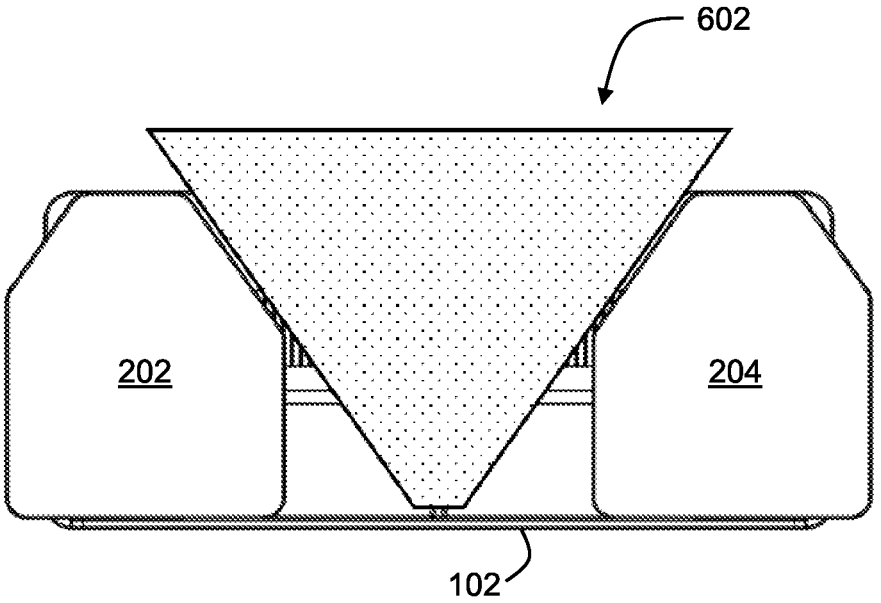

In some embodiments as shown in FIGS. 19, a first tool 602 is used to increase the width $W_A$ of the adjustment assembly 12. The tool 602 includes a first edge 604 angled to correspond with the angle of the first shim member's upper right chamfer 220, and a second edge 606 angled to correspond with the angle of the second shim member's upper left chamfer 234. The tool 602 is placed with its first and second edges 604, 606 engaging the chamfers 220, 234, respectively, and a downward force $F_{T1}$ is applied to the tool 602. This downward force $F_{T1}$ results in the downward force $F_5$ applied to the chamfer 220 that translates into the lateral force $F_6$ applied to the member 202 that causes the member 202 to move in the direction of arrow A, and the downward force $F_7$ applied to the chamfer 234 that translates into the lateral force $F_8$ applied to the member 204 that causes the member 204 to move in the direction of arrow C. The result is a lateral movement and separating of the members 202, 204 as shown in FIG. 20, and a widening of the width $W_A$ of the adjustment assembly as described above.

Figure 21:
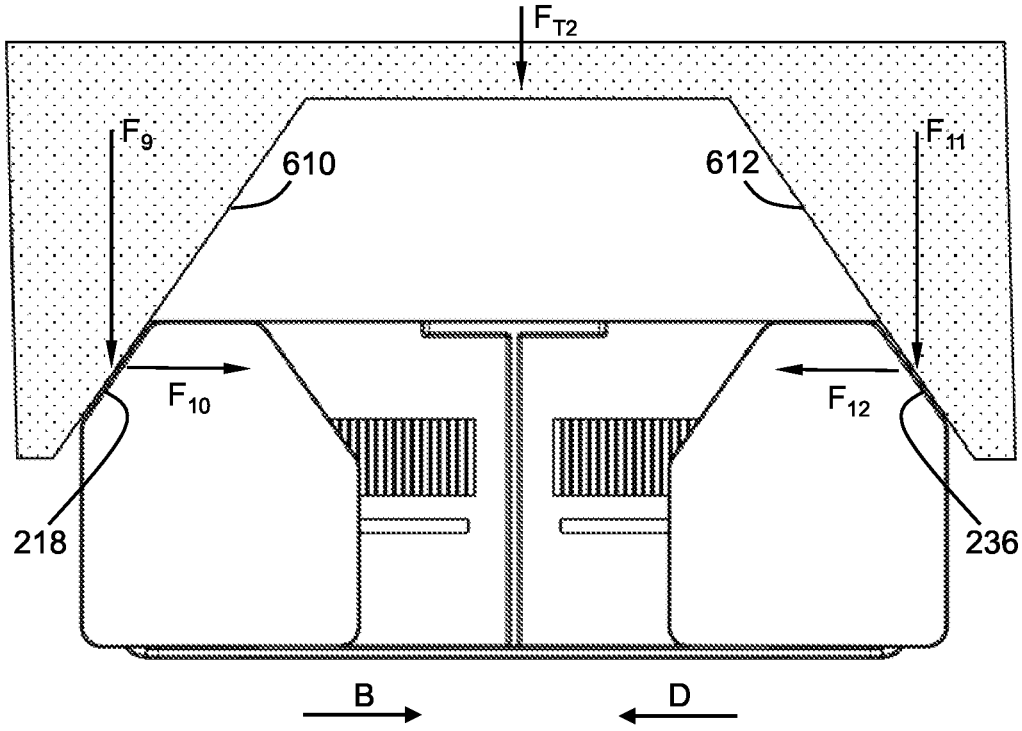
Figure 22:
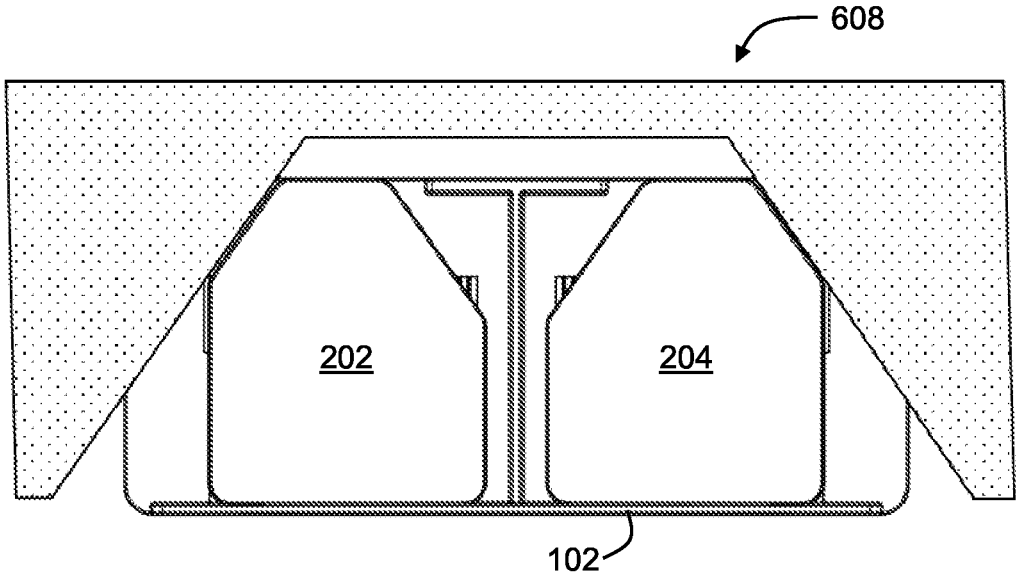

In some embodiments as shown in FIG. 21, a second tool 608 is used to decrease the width $W_A$ of the adjustment assembly 12. The tool 608 includes a first edge 610 angled to correspond with the angle of the first shim member's upper left chamfer 218, and a second edge 612 angled to correspond with the angle of the second shim member's upper right chamfer 236. The tool 608 is placed with its first and second edges 610, 612 engaging the chamfers 218, 236, respectively, and a downward force $F_{T2}$ is applied to the tool 608. This downward force $F_{T2}$ results in the downward force $F_9$ applied to the chamfer 218 that translates into the lateral force $F_{10}$ applied to the member 202 that causes the member 202 to move in the direction of arrow B, and the downward force $F_{11}$ applied to the chamfer 236 that translates into the lateral force $F_{12}$ applied to the member 204 that causes the member 204 to move in the direction of arrow D. The result is a lateral movement and a bringing together of the members 202, 204 as shown in FIG. 22, and a decreasing of the width $W_A$ of the adjustment assembly 12 as described above.

It is preferable that the first and second tools 602, 608 are adapted to fit within the left inner channel 418 and/or the right inner channel 420 (see FIG. 12) in order to engage the shim members 202, 204 configured therein as described above.

Benefits of the System 10

The benefits of the system 10 are multifold and include, without limitation:

First, the system 10 works for most glass compositions and thicknesses, thereby reducing inventory costs of different securing devices.

Second, the system 10 is quick and easy to install and/or remove.

Third, simple single-part implementation tools 600 may be used to install and remove the system 10.

Fourth, the system 10 facilitates the quick and easy adjustment of the glass within the base shoe housing 400.

Fifth, the adjustment assembly 12 provides increased contact area with the panel 300 thereby reducing stress to the glass under emergency loads, minimizing breakage.

Sixth, the system 10 is resistant to chemicals, temperature extremes and sun exposure.

It is understood that the benefits shown above are meant for demonstration and that other benefits of the system 10 may also exist. Those of ordinary skill in the art will appreciate and understand, upon reading this description, that embodiments hereof may provide different and/or other advantages, and that not all embodiments or implementations need have all advantages.

It also is understood that any aspect or detail of any embodiment described herein or otherwise may be combined with any other aspect or detail of any other embodiment to form any additional embodiments that also are within the scope of the system 10. For example, the adjustment assembly 12 may comprise a single shim member (e.g., shim member 202) and the adjustment assembly's left portion 14 only. In another example, two first shim members 202 may be oriented back-to-back with opposing taper directions to form an adjustment assembly 12, and the overlapping shim members 202 may be moved laterally in relation to one another to increase and/or decrease the overall width of the combined members 202. It can be seen that the concepts described above in relation to the adjustment member 12 also apply to these configurations in regard to downward forces applied to the shims' chamfers that are translated into lateral forces.

It is understood that other configurations of other numbers of shim members and/or base plates may be used to translate vertical forces into lateral forces and to thereby vary the width of the configurations.

Where a process is described herein, those of ordinary skill in the art will appreciate that the process may operate without any user intervention. In another embodiment, the process includes some human intervention (e.g., a step is performed by or with the assistance of a human).

As used herein, including in the claims, the phrase "at least some" means "one or more," and includes the case of only one. Thus, e.g., the phrase "at least some ABCs" means "one or more ABCs", and includes the case of only one ABC.

As used herein, including in the claims, term "at least one" should be understood as meaning "one or more", and therefore includes both embodiments that include one or multiple components. Furthermore, dependent claims that refer to independent claims that describe features with "at least one" have the same meaning, both when the feature is referred to as "the" and "the at least one".

As used in this description, the term "portion" means some or all. So, for example, "A portion of X" may include some of "X" or all of "X". In the context of a conversation, the term "portion" means some or all of the conversation.

As used herein, including in the claims, the phrase "using" means "using at least," and is not exclusive. Thus, e.g., the phrase "using X" means "using at least X." Unless specifically stated by use of the word "only", the phrase "using X" does not mean "using only X."

As used herein, including in the claims, the phrase "based on" means "based in part on" or "based, at least in part, on," and is not exclusive. Thus, e.g., the phrase "based on factor X" means "based in part on factor X" or "based, at least in part, on factor X." Unless specifically stated by use of the word "only", the phrase "based on X" does not mean "based only on X."

In general, as used herein, including in the claims, unless the word "only" is specifically used in a phrase, it should not be read into that phrase.

As used herein, including in the claims, the phrase "distinct" means "at least partially distinct." Unless specifically stated, distinct does not mean fully distinct. Thus, e.g., the phrase, "X is distinct from Y" means that "X is at least partially distinct from Y," and does not mean that "X is fully distinct from Y." Thus, as used herein, including in the claims, the phrase "X is distinct from Y" means that X differs from Y in at least some way.

It should be appreciated that the words "first," "second," and so on, in the description and claims, are used to distinguish or identify, and not to show a serial or numerical limitation. Similarly, letter labels (e.g., "(A)", "(B)", "(C)", and so on, or "(a)", "(b)", and so on) and/or numbers (e.g., "(i)", "(ii)", and so on) are used to assist in readability and to help distinguish and/or identify, and are not intended to be otherwise limiting or to impose or imply any serial or numerical limitations or orderings. Similarly, words such as "particular," "specific," "certain," and "given," in the description and claims, if used, are to distinguish or identify, and are not intended to be otherwise limiting.

As used herein, including in the claims, the terms "multiple" and "plurality" mean "two or more," and include the case of "two." Thus, e.g., the phrase "multiple ABCs," means "two or more ABCs," and includes "two ABCs." Similarly, e.g., the phrase "multiple PQRs," means "two or more PQRs," and includes "two PQRs."

The present invention also covers the exact terms, features, values and ranges, etc. in case these terms, features, values and ranges etc. are used in conjunction with terms such as about, around, generally, substantially, essentially, at least etc. (i.e., "about 3" or "approximately 3" shall also cover exactly 3 or "substantially constant" shall also cover exactly constant).

As used herein, including in the claims, singular forms of terms are to be construed as also including the plural form and vice versa, unless the context indicates otherwise. Thus, it should be noted that as used herein, the singular forms "a," "an," and "the" include plural references unless the context clearly dictates otherwise.

Throughout the description and claims, the terms "comprise", "including", "having", and "contain" and their variations should be understood as meaning "including but not limited to", and are not intended to exclude other components unless specifically so stated.

It will be appreciated that variations to the embodiments of the invention can be made while still falling within the scope of the invention. Alternative features serving the same, equivalent or similar purpose can replace features disclosed in the specification, unless stated otherwise. Thus, unless stated otherwise, each feature disclosed represents one example of a generic series of equivalent or similar features.

The present invention also covers the exact terms, features, values and ranges, etc. in case these terms, features, values and ranges etc. are used in conjunction with terms such as about, around, generally, substantially, essentially, at least etc. (i.e., "about 3" shall also cover exactly 3 or "substantially constant" shall also cover exactly constant).

Use of exemplary language, such as "for instance", "such as", "for example" ("e.g.,") and the like, is merely intended to better illustrate the invention and does not indicate a limitation on the scope of the invention unless specifically so claimed.

While the invention has been described in connection with what is presently considered to be the most practical and preferred embodiments, it is to be understood that the invention is not to be limited to the disclosed embodiment, but on the contrary, is intended to cover various modifications and equivalent arrangements included within the spirit and scope of the appended claims.

The invention claimed is:

1. A method of releasably securing a panel within a base shoe, the method comprising:

(A) providing a first tapered member including a first end and a second end and a width that tapers from the first end to the second end and including a first upper chamfer near the first end and a second upper chamfer near the second end;

(B) providing a second tapered member including a first end and a second end and a width that tapers from the first end to the second end and including a third upper chamfer near the first end and a fourth upper chamfer near the second end;

(C) providing a back plate including a first end and a second end and a first front back plate surface that defines a first portion near the first end and a second front back plate surface that defines a second portion near the second end, wherein a width of the first portion tapers from a position near the first end to a first position between the first end and the second end defining a first portion taper direction, and a width of the second portion tapers from a position near the second end to a second position between the first end and the second end defining a second portion taper direction;

(D) overlaying the first tapered member with the first front back plate surface with the first member taper direction opposite the first portion taper direction and the second tapered member with the second front back plate surface with a second member taper direction opposite the second portion taper direction to form an adjustment assembly, wherein the first tapered member is movable independently of the second tapered member;

(E) positioning the adjustment assembly between a surface of the panel and a surface of the base shoe;

(F) applying a downward force to the first upper chamfer and/or the third upper chamfer to secure the panel.

2. The method of claim 1 further comprising:

(G) applying a downward force to the second upper chamfer and/or the fourth upper chamfer to release the panel.

3. The method of claim 2 wherein the downward force to the second upper chamfer in (G) is translated into a first lateral force to the first tapered member causing the first tapered member to translate laterally with respect to the back plate, and/or the downward force to the fourth upper chamfer in (G) is translated into a second lateral force to the second tapered member causing the second tapered member to translate laterally with respect to the back plate.

4. The method of claim 2 wherein the downward force in (G) causes the first tapered member and/or the second tapered member to translate laterally thereby decreasing a width of the adjustment assembly.

5. The method of claim 1 wherein the downward force to the first upper chamfer in (F) is translated into a first lateral force to the first tapered member causing the first tapered member to translate laterally with respect to the back plate, and/or the downward force to the third upper chamfer in (F) is translated into a second lateral force to the second tapered member causing the second tapered member to translate laterally with respect to the back plate.

6. The method of claim 1 wherein the downward force in (F) causes the first tapered member and/or the second tapered member to translate laterally thereby increasing a width of the adjustment assembly.

7. The method of claim 1 wherein the base shoe includes a channel with at least one inner surface, and the positioning of the adjustment assembly in (E) includes positioning the adjustment assembly between the at least one inner surface of the base shoe and the surface of the panel.

8. The method of claim 1 wherein the overlaying of the first tapered member and the second tapered member in (D) results in the first and second tapered members mirroring one another.

9. A system for securing a panel within a base shoe, the system comprising:

a first tapered member including a first end, a second end and a width that tapers from the first end to the second end that defines a first member taper direction and including a first upper chamfer near the first end and a second upper chamfer near the second end;

a second tapered member including a first end and a second end and a width that tapers from the first end to the second end defining a second member taper direction and including a third upper chamfer near the first end and a fourth upper chamfer near the second end;

a back plate including a first end and a second end and a first front back plate surface that defines a first portion near the first end and a second front back plate surface that defines a second portion near the second end, wherein a width of the first portion tapers from a position near the first end to a first position between the first end and the second end defining a first portion taper direction, and a width of the second portion tapers from a position near the second end to a second position between the first end and the second end defining a second portion taper direction;

wherein the first tapered member is adapted to overlay the first front back plate surface with the first member taper direction opposite the first portion taper direction, and/or the second tapered member is adapted to overlay the second front back plate surface with the second member taper direction opposite the second portion taper direction, and wherein the first tapered member is movable independently of the second tapered member.

10. The system of claim 9 wherein the first tapered member and/or the second tapered member is adapted to slide laterally in relation to the back plate.

11. The system of claim 9 wherein the first tapered member includes a first member front surface and a first member back surface that define the first width, and the first member back surface is adapted to slide laterally upon the first front back plate surface, and/or the second tapered member includes a second member front surface and a second member back surface that define the second width, and the second member back surface is adapted to slide laterally upon the second front surface.

12. The system of claim 9 wherein the width of the first portion near the first end is generally equal to the width of the second portion near the second end.

13. The system of claim 9 wherein the first position between the first end and the second end of the back plate corresponds to the second position between the first end and the second end of the back plate.

14. The system of claim 9 wherein the first tapered member and the second tapered member mirror one another.

* * * * *